US006937215B2

(12) United States Patent
Lo

(10) Patent No.: US 6,937,215 B2
(45) Date of Patent: Aug. 30, 2005

(54) PIXEL DRIVING CIRCUIT OF AN ORGANIC LIGHT EMITTING DIODE DISPLAY PANEL

(75) Inventor: Shin-Tai Lo, Miaoli (TW)

(73) Assignee: Wintek Corporation, Taichung (TW)

( * ) Notice: Subject to any disclaimer, the term of this patent is extended or adjusted under 35 U.S.C. 154(b) by 0 days.

(21) Appl. No.: 10/698,477

(22) Filed: Nov. 3, 2003

(65) Prior Publication Data

US 2005/0093791 A1 May 5, 2005

(51) Int. Cl.[7] ..... G09G 3/32
(52) U.S. Cl. ..... 345/82; 345/76; 345/92
(58) Field of Search ..... 345/55, 76, 82, 345/92; 315/169.1, 169.2, 169.3; 340/815.45

(56) References Cited

U.S. PATENT DOCUMENTS 6,362,798 B1 3/2002 Kimura et al.
6,753,655 B2 * 6/2004 Chen et al. ..... 315/169.3
6,777,886 B1 * 8/2004 Lo et al. ..... 315/169.1
6,778,151 B2 * 8/2004 Li ..... 345/55
6,781,320 B2 * 8/2004 Park et al. ..... 315/169.1
6,781,567 B2 * 8/2004 Kimura ..... 345/92

OTHER PUBLICATIONS

P–104: A New Voltage Modulated AMOLDED Pixel Design Compensating Threshold Voltage Variation of Poly–Si TFTs, Sang–Hoon Jung et al. pp. 622–625.

* cited by examiner

*Primary Examiner*—Dennis-Doon Chow
(74) *Attorney, Agent, or Firm*—Birch, Stewart, Kolasch & Birch, LLP

(57) ABSTRACT

A pixel driving circuit of an organic light emitting diode display panel includes a scan TFT, a Vdd-connected TFT, a driving TFT, a diode-connected TFT, a storage capacitor, a reset TFT, an OLED-connected TFT, and an organic light emitting diode. A reset TFT is connected to the diode-connected TFT and a previous scan line. An OLED-connected TFT is connected to the driving TFT and the light-emitting line. An organic light emitting diode is connected to the OLED-connected TFT and the ground. The amount of output current to the OLED does not depend on the threshold voltage of the driving TFT and only depends on the amount of the data signal voltage to be written. Thus, the variance in the threshold voltage of the driving TFT caused by the factor of the manufacturing process can be compensated to improve the non-uniform image defect.

13 Claims, 5 Drawing Sheets

PIXEL DRIVING CIRCUIT OF AN ORGANIC LIGHT EMITTING DIODE DISPLAY PANEL

FIELD OF THE INVENTION

The present invention relates to a pixel driving circuit of an organic light emitting diode display panel and, more particularly, to a pixel driving circuit can improve the image uniformity of the active matrix type organic light emitting diode display panel with low temperature poly-silicon thin firm transistors.

BACKGROUND OF THE INVENTION

According to the driving types for organic light emitting diode (mentioned as OLED hereafter) displays, the OLED displays are divided into passive matrix type OLED (mentioned as PMOLED hereafter) and active matrix type OLED (mentioned as AMOLED hereafter). The so-called active matrix type OLED (AMOLED) utilizes thin film transistors (mentioned as TFT hereafter) and capacitors to store signals and thereby controls the brightness and the gray scale of the OLED.

Although the manufacturing cost and the technical level of the passive matrix type OLED (PMOLED) are lower, the PMOLED is restricted by the driving method, and then the resolution of the OLED cannot be enlarged. Thus, the size of the product of the PMOLED is restricted within 5 inch, and the application of the product of the PMOLED will be restricted to the application of low resolution and small size. If the requirement of the product of the OLED is high resolution and large size, the main type is the active matrix type. The so-called active matrix type utilizes capacitors storing signals, so the pixel still maintains the original brightness after the line has been scanned. In contrast to the passive matrix type, the pixel cannot light until the scan line selects the pixel. Thus, it is not necessary that OLED of the active matrix type is driven to very high brightness, and the active matrix type OLED have a better lifetime and meet the requirement for high resolution. The OLED is integrated with the technology of the TFT to realize the active matrix OLED and the above-mentioned advantageous property of the OLED is fully expressed.

The manufacturing processes of the TFT formed on a glass substrate include amorphous silicon (mentioned as a-Si hereafter) manufacturing process and low temperature poly-silicon (mentioned as LTPS hereafter) manufacturing process. The differences between the LTPS TFT and the a-Si TFT are the electric characteristics of the TFT devices and the complexity of the manufacturing process. The mobility of the carrier of the LTPS TFT is higher than that of the a-Si TFT and the higher mobility of the carrier means that the TFT can provide much more electric current under the same voltage bias, but the manufacturing process of the LTPS TFT is more complex. Contrary to the LTPS TFT, the mobility of the carrier of a-Si TFT is less than that of LTPS TFT, but the manufacturing process of a-Si TFT is simple and superiorly competes with other ones in cost.

The manufacturing process of the LTPS is not mature, and the threshold voltage and the mobility of the LTPS TFT elements may vary, therefore, the property of each TFT element can be different. Although the same image data signal voltages are inputted to the pixels, the OLEDs of the pixels generate different output electric current, such that the brightness emitted by the OLED of the different pixel of a display panel is different. For above reason, the result leads the OLED display panel to display an image with erroneous gray scale and to have bad image uniformity.

In order to resolve the above-mentioned problem, U.S. Pat. No. 6,362,798, entitled "Transistor Circuit, Display Panel And Electronic Apparatus", discloses a pixel circuit as shown in FIG. 5. The above-mentioned patent is characterized in that a compensating TFT M2 with a diode-connected type is disposed at the circuit between the terminal of a data signal voltage Vsig and a storage capacitor C2. An electric current flows from the data signal voltage terminal Vsig to a joint G, though a switching TFT M1, the compensating TFT M2 and the storage capacitor C2, and finally is equal to zero because the voltage of the joint G is higher and higher. Simultaneously, the compensating TFT has a voltage drop Vth_comp between two ends thereof, so the voltage of the joint G is equal to Vsig minus Vth_comp (Vsig−Vth_comp). Thus, the amount of an electric current I flowing through an OLED is equal to:

$$I=(½)\times\beta\times(Vsg_\text{driv}-Vth_\text{driv})^2$$

$$I=(½)\times\beta\times(Vc-Vsig+Vth_\text{comp}-Vth_\text{driv})^2,$$

wherein β is the transconductance parameter of the driving TFT M4. By the above-mentioned formulas, it is seen that if the Vth_comp is equal to a Vth_driv (the threshold voltage of the driving TFT M4) during the manufacturing process, the amount of output current of the OLED will not influenced by the threshold voltage of the driving TFT M4 and only depends on the amount of the data signal voltage Vsig. Thus, the driving TFT M4 which of the variance in the threshold voltage caused by the factor of the manufacturing process can be compensated.

In order to resolve similar conventional problem, a thesis, entitled "A New Modulated AMOLED Pixel Design Compensating Threshold Voltage Variation of Poly-Si TFTs", published by Seoul University (Korea), also discloses a pixel circuit as shown in FIG. 6. The thesis is characterized in that a transistor P3 with a diode-connected type is disposed at the circuit between the terminal of a data signal voltage Vdata and a storage capacitor C3. An electric current flows from the terminal of the data signal voltage Vdata to the gate of a transistor P2, though a transistors P1, P3 and the storage capacitor C3, and finally is equal to zero because the voltage of the gate of the transistor P2 becomes higher and higher. Simultaneously, the transistor P3 has a voltage drop Vth3 between two ends thereof, so the voltage of the gate of the transistor P2 is Vdata minus Vth3 (i.e. Vdata−Vth3). Thus, the amount of an electric current I flowing through an OLED 650 is equal to:

$$I=(½)\times\beta\times(Vsg\mathbf{2}-Vth\mathbf{2})^2$$

$$I=(½)\times\beta\times(Vdd-Vdata+Vth\mathbf{3}-Vth\mathbf{2})^2,$$

wherein β is the transconductance parameter of the transistor P2. The thesis being similar to the above-mentioned parent, by the above-mentioned formulas, it is seen that if the Vth3 should be equal to a Vth2 (the threshold voltage of the transistor P2) during the manufacturing process, and the amount of output current of the OLED 650 will not influenced by the voltage Vth2 (the threshold voltage of the transistor P2) and only depends on the amount of the data signal voltage (Vdata). Thus, the transistor P2 of which the variance in the threshold voltage caused by the factor of the manufacturing process can be compensated.

As described above, according to the U.S. Pat. No. 6,362,798, the requirement of the manufacturing process is higher, so as to be disadvantageous for the production yield of display panels. The patent mainly discloses that the Vth_comp must be equal to a Vth_driv during the manufacturing process, so the driving TFT M4 which of the variance in the threshold voltage caused by the factor of the manufacturing process can be compensated and the amount of output current of the OLED doesn't depend on the threshold voltage of the driving TFT M4.

Technology of the thesis published by Seoul University (Korea) is similar to that of the U.S. Pat. No. 6,362,798. According to the thesis, the requirement of the manufacturing process is also higher, so as to be disadvantageous for the production yield of display panels. The thesis mainly disclose that the Vth3 must be almost equal to the Vth2 during the manufacturing process, so the thin film transistor of which the variance in the threshold voltage caused by the factor of the manufacturing process can be compensated and the amount of output current of the OLED 650 doesn't depend on the self threshold voltage of the transistor P2.

Accordingly, there exists a need for a pixel driving circuit of an organic light emitting diode display panel to solve the above-mentioned problems and disadvantages.

SUMMARY OF THE INVENTION

It is a primary object of the present invention to mainly discloses that the condition of a Vth_comp (the threshold voltage of a compensating TFT) being equal to a Vth_driv (the threshold voltage of a driving TFT) during the manufacturing process is not required, but the effect of the variation in the threshold voltage of the driving TFT can be precisely completely compensated by the invention.

It is another object of the present invention to utilize the technology of a developed TFT-LCD Source IC to support the driving of TFT-OLED when the key component, e.g. TFT-OLED Data Driver IC, is not completely developed.

It is a further object of the present invention to provide a voltage driving type active matrix OLED display panels having the threshold voltage of the TFT which can be compensated, and to improve the non-uniform image defect caused by uneven character of the threshold voltage of the TFTs.

In order to achieve the foregoing objects, the present invention provides a pixel driving circuit of an organic light emitting diode display panel display panel. The organic light emitting diode display panel display panel includes at least one scan line and data line crosswise constituting at least one pixel having a light-emitting line and a power supply. The pixel driver circuit disposed on the pixel comprises a scan TFT, a Vdd-connected TFT, a driving TFT, a diode-connected TFT, a storage capacitor, a reset TFT, an OLED-connected TFT, and an organic light emitting diode. A scan TFT has a gate connected to the scan line and a source connected to the data line. A Vdd-connected TFT has a source connected to the power supply (Vdd), a drain connected to the drain of the scan TFT, and a gate connected to the light-emitting line. A driving TFT has a source connected to the drain of the Vdd-connected TFT. A diode-connected TFT has a source connected to the drain of the driving TFT and a gate connected to the scan line. A storage capacitor has one end connected to the gate of the driving TFT and the drain of the diode-connected TFT, and the other end connected to the power supply (Vdd). A reset TFT has a source connected to the drain of the diode-connected TFT, and a gate and a drain formed to a diode-connected type and connected to the junction connected to a previous scan line. An OLED-connected TFT has a source connected to the drain of the driving TFT and a gate connected to the light-emitting line. An organic light emitting diode has one end being an anode and connected to the drain of the OLED-connected TFT, and the other end being cathode and connected to the ground.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
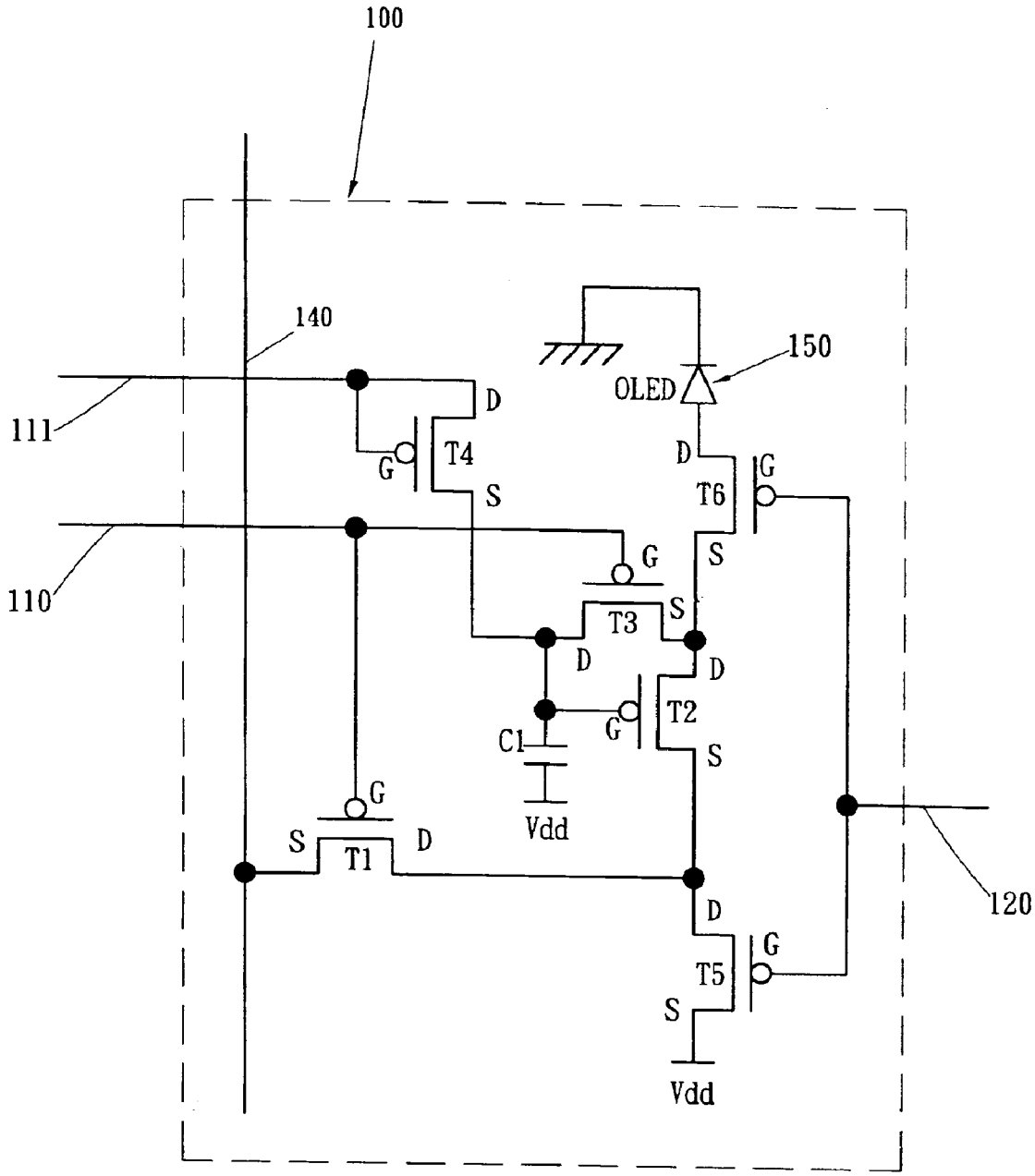
FIG. 1 is the schematic view of a pixel driving circuit according to the present invention.

The First Embodiment:

Referring to FIG. 1, it is the schematic view of a pixel driving circuit according to the present invention. Each scan line 110 and each data line 140, which are disposed on a display panel according to the present invention, crosswise constitute a pixel 100. The pixel driving circuit disposed on the pixel 100 includes:

a scan TFT T1, of which a gate (G) is connected to the scan line 110 and of which a source (S) is connected to the data line 140;

a Vdd-connected TFT T5, of which a source (S) is connected to a power supply (Vdd), of which a drain (D) is connected to the drain (D) of the scan TFT T1, and of which a gate (G) is connected to a light-emitting line 120 disposed on the pixel 100;

a driving TFT T2, of which a source (S) is connected to the drain (D) of the Vdd-connected TFT T5 and of which a drain (D) is connected to the source (S) of the OLED-connected TFT T6;

a diode-connected TFT T3, of which a source (S) is connected to the drain (D) of the driving TFT T2 and of which a gate (G) is connected to the scan line 110;

a storage capacitor C1, having one end connected to the gate (G) of the driving TFT T2 and the drain (D) of the diode-connected TFT T3, and the other end connected to the power supply (Vdd);

a reset TFT T4, of which a source (S) is connected to the drain (D) of the diode-connected TFT T3 and of which a gate (G) and a drain (D) are formed to a diode-connected type and connected to the junction connected to a previous scan line 111;

an OLED-connected TFT T6, of which a source (S) is connected to the drain (D) of the driving TFT T2 and of which a gate (G) is connected to the light-emitting line 120 of the pixel 100; and an organic light emitting diode 150, of which one end is an anode and connected to the drain (D) of the OLED-connected TFT T6, and of which the other end is cathode and connected to ground;

wherein the gate (G) of the Vdd-connected TFT T5 and the gate (G) of the OLED-connected TFT are controlled by the same light-emitting line 120. The driving TFT T2 is formed a diode-connected type by the diode-connected TFT T3.

Thus, the amount of the electric current flowing through the OLED 150 of the pixel 100 according to the present invention can depends on the voltage of the storage capacitor C1 connected to the gate (G) of the driving TFT T2.

The principle of the operation of the pixel driving circuit is described as follows:

Step 1: When the scan action is carried out on the previous scan line 111 of the pixel 100, the electrical potential of the previous scan line 111 is equal to zero. Thus, the storage capacitor C1 can be charged by the reset TFT T4 and finally the terminal voltage of the gate (G) of the driving TFT T2 is equal to the Vth4 (the threshold voltage of the reset TFT T4). In this step, the light-emitting line 120 disposed on the pixel 100 can turn off the Vdd-connected TFT T5 and the OLED-connected TFT T6, and therefore there is no electric current flowing through the OLED 150, so as to prevent the OLED 150 from suddenly lighting and to maintain the contrast of the entire image.

Step 2: When the scan action is continuously carried out on the scan line 110 disposed on the pixel 100, the electrical potential of the scan line 110 is equal to zero and simultaneously the scan TFT T1 and the diode-connected TFT T3 can be turned on. The gate (G) and the drain (D) of the driving TFT T2 are connected to each other and the driving TFT T2 is formed to a diode-connected type, because the diode-connected TFT T3 is turned on. The data voltage of the data line 140 proceeds to discharge the storage capacitor C1 through the scan TFT T1 and the driving TFT T2 with the diode-connected type. If the data voltage of the data line 140 is equal to Vdata, the terminal voltage of gate (G) of the driving TFT T2 gradually changes from Vth4 to Vdata−Vth2. Simultaneously, the electrical potential of the previous scan line 111 is equal to Vdd (the electrical potential of the power supply) and therefore the reset TFT T4 with the diode-connected type is turned off because of reverse bias. In addition, in this step, the light-emitting line 120 disposed on the pixel 100 also turns off the Vdd-connected TFT T5 and the OLED-connected TFT T6.

Step 3: When the scan action is continuously carried out on next scan line disposed on the pixel 100, the electrical potential of the scan line 110 disposed on the pixel 100 is equal to Vdd again and simultaneously the scan TFT T1 and the diode-connected TFT T3 can be turned off. Simultaneously, the light-emitting line 120 disposed on the pixel 100 can turn on the Vdd-connected TFT T5 and the OLED-connected TFT T6, and therefore there is an electric current flowing the OLED 150. Because the Vdd-connected TFT T5 is turned on, the terminal voltage of the source (S) of the driving TFT T2 is equal to Vdd, and then the terminal voltage of the gate (G) of the driving TFT T2 is equal to Vdata−Vth2, such that the amount of the current I flowing though the OLED 150 can be described as follows:

$$I=(½)\times\beta\times(Vsg2-Vth2)^2$$

$$I=(½)\times\beta\times(Vdd-Vdata+Vth2-Vth2)^2$$

$$I=(½)\times\beta\times(Vdd-Vdata)^2,$$

wherein β is the transconductance parameter of the driving TFT T2. By the above-mentioned formulas, it is seen that the amount of output current of the OLED 150 does not depend on the Vth2 (the threshold voltage of the driving TFT T2) and only depends on the amount of the data signal voltage (Vdata) to be written. Thus, the variance in the threshold voltage of the driving TFT T2 caused by the factor of the manufacturing process can be compensated.

Figure 2:
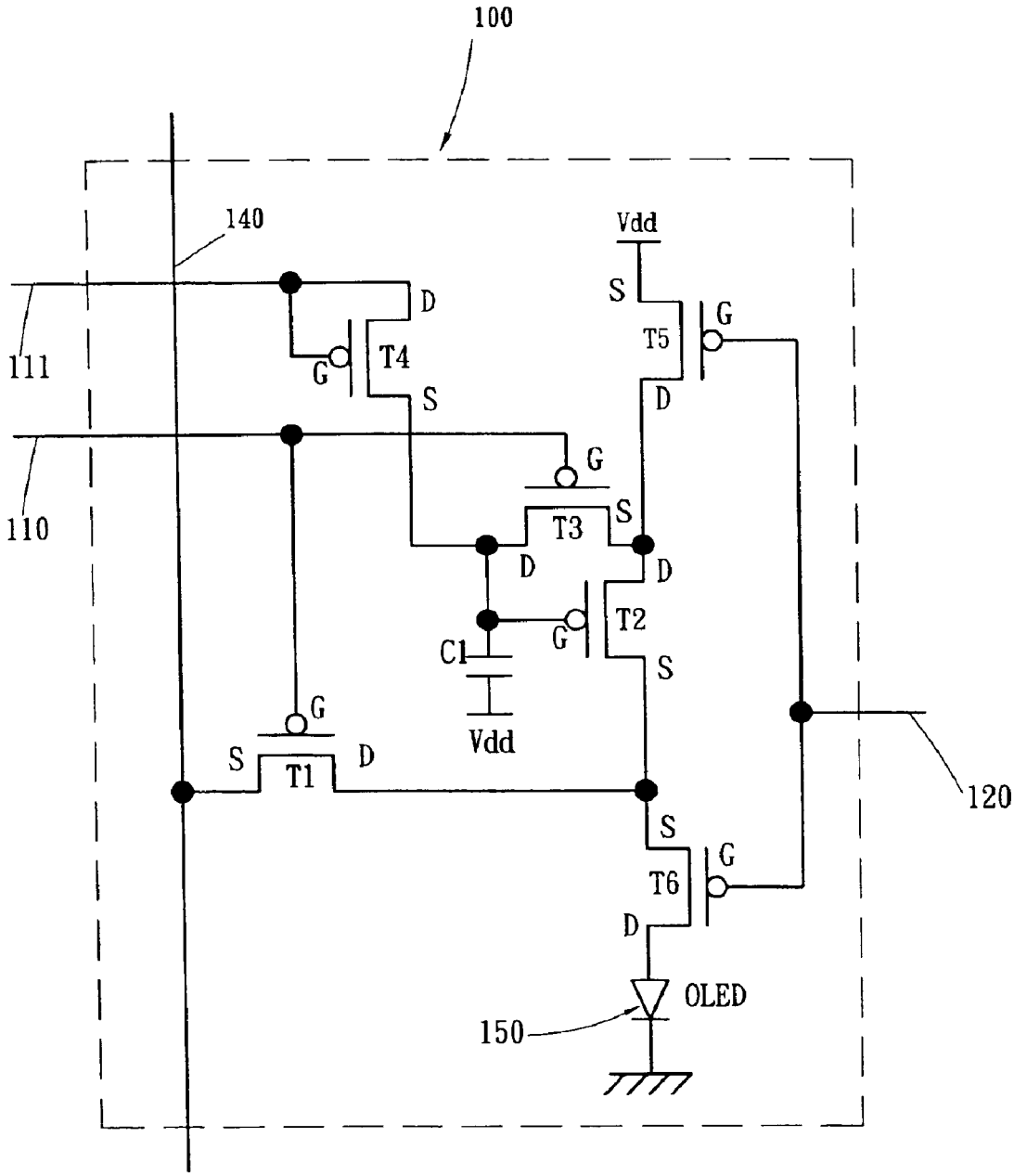
FIG. 2 is the schematic view of another pixel driving circuit according to the present invention.

The Second Embodiment:

Referring to FIG. 2, it is the schematic view of another pixel driving circuit according to the present invention. Each scan line 110 and each data line 140, which are disposed on a display panel according to the present invention, crosswise constitute a pixel 100. The pixel driving circuit disposed on the pixel 100 includes:

a scan TFT T1, of which a gate (G) is connected to the scan line 110 and of which a source (S) is connected to the data line 140;

an OLED-connected TFT T6, of which a source (S) is connected to the drain (D) of the scan TFT T1 and of which a gate (G) is connected to the light-emitting line 120 of the pixel 100;

an OLED 150, of which one end is an anode and connected to the drain (D) of the OLED-connected TFT T6, and of which the other end is cathode and connected to ground;

a driving TFT T2, of which a drain (D) is connected to the drain (D) of the Vdd-connected TFT T5 and of which a source (S) is connected to the source (S) of the OLED-connected TFT T6;

a diode-connected TFT T3, of which a source (S) is connected to the drain (D) of the driving TFT T2 and of which a gate (G) is connected to the scan line 110;

a storage capacitor C1, having one end is connected to the gate (G) of the driving TFT T2 and the drain (D) of the diode-connected TFT T3, and the other end is connected to the power supply (Vdd);

a reset TFT T4, of which a source (S) is connected to the drain (D) of the diode-connected TFT T3 and of which a gate (G) and a drain (D) are formed to a diode-connected type and connected to the junction connected to a previous scan line 111; and a Vdd-connected TFT T5, of which a source (S) is connected to a power supply (Vdd) and, of which a drain (D) is connected to the drain (D) of driving TFT T2, and of which a gate (G) is connected to a light-emitting line 120 of the pixel 100;

wherein the gate (G) of the Vdd-connected TFT T5 and the gate (G) of the OLED-connected TFT are controlled by the same light-emitting line 120. The driving TFT T2 is formed a diode-connected type by the diode-connected TFT T3.

Thus, the amount of the electric current flowing through the OLED 150 of the pixel 100 according to the present invention can depends on the voltage of the storage capacitor C1 connected to the gate (G) of the driving TFT T2.

As described above, the difference between the second embodiment and the first embodiment is that the junction of the driving TFT T2 and the Vdd-connected TFT T5 and the junction of the driving TFT T2 and the OLED-connected TFT T5 are interchanged with each other.

The principle of the operation of the pixel driving circuit in the second embodiment is described as follows:

Step 1: When the scan action is carried out on the previous scan line 111 of the pixel 100, the electrical potential of the previous scan line 111 is equal to zero. Thus, the storage capacitor C1 can be charged by the reset TFT T4 and finally the terminal voltage of the gate (G) of the driving TFT T2 is equal to the Vth4 (the threshold voltage of the reset TFT T4). In this step, the light-emitting line 120 disposed on the pixel 100 can turn off the Vdd-connected TFT T5 and the OLED-connected TFT T6, and therefore there is no electric current flowing through the OLED 150, so as to prevent the OLED 150 from suddenly lighting and to maintain the contrast of the entire image.

Step 2: When the scan action is continuously carried out on the scan line 110 disposed on the pixel 100, the electrical potential of the scan line 110 is equal to zero and simultaneously the scan TFT T1 and the diode-connected TFT T3 are turned on. The gate (G) and the drain (D) of the driving TFT T2 are connected to each other and the driving TFT T2 is formed to a diode-connected type, because the diode-connected TFT T3 is turned on. The data voltage of the data line 140 proceeds to discharge the storage capacitor C1 through the scan TFT T1 and the driving TFT T2 with the diode-connected type. If the data voltage of the data line 140 is equal to Vdata, the terminal voltage of gate (G) of the driving TFT T2 gradually change from Vth4 to Vdata−Vth2, and the location of the source (S) of the driving TFT T2 is defined at lower side of the driving TFT T2 as shown in FIG. 2. Simultaneously, the electrical potential of the previous scan line 111 is equal to Vdd (the electrical potential of a power supply) and therefore the reset TFT T4 with the diode-connected type is turned off because of reverse bias. In addition, in this step, the light-emitting line 120 disposed on the pixel 100 also turns off the Vdd-connected TFT T5 and the OLED-connected TFT T6.

Figure 3:
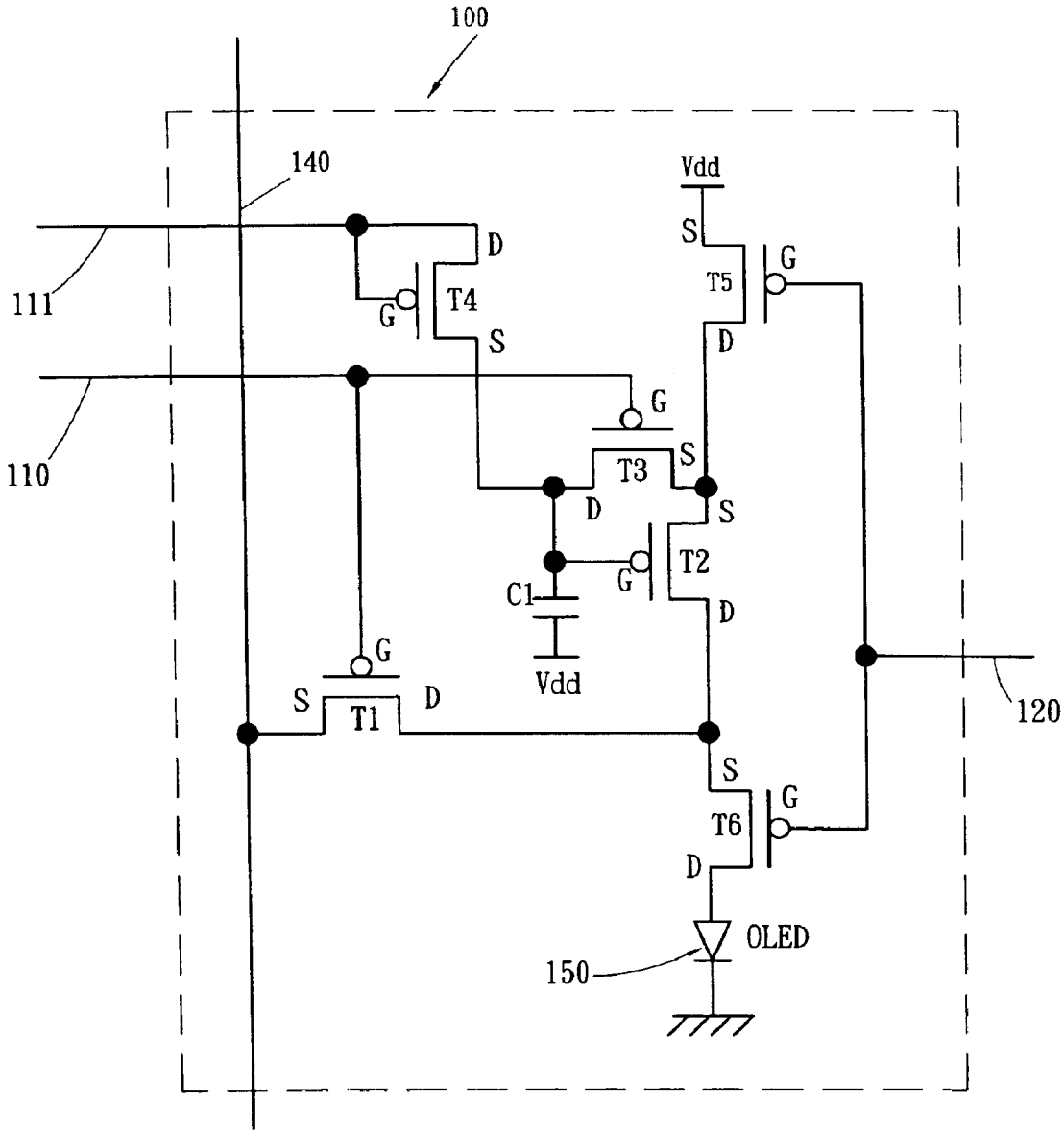
FIG. 3 is the schematic view of a further pixel driving circuit according to the present invention.

Step 3: When the scan action is continuously carried out on next scan line disposed on the pixel 100, the electrical potential of the scan line 110 disposed on the pixel 100 is equal to Vdd again and simultaneously the scan TFT T1 and the diode-connected TFT T3 are turned off. Simultaneously, the light-emitting line 120 disposed on the pixel 100 can turn on the Vdd-connected TFT T5 and the OLED-connected TFT T6, and therefore there is an electric current flowing the OLED 150. Simultaneously, the location of the junction of the driving TFT T2 and the Vdd-connected TFT T5 is at upper side of the driving TFT T2, and therefore the location of the source (S) of the driving TFT T2 is defined at upper side of the driving TFT T2 as shown FIG. 3. The location of the source (S) of the driving TFT T2 in this step 3 differs from that in the previous step 2. Because the Vdd-connected TFT T5 is turned on, the terminal voltage of the source (S) of the driving TFT T2 is equal to Vdd, and then the terminal voltage of the gate (G) of the driving TFT is equal to Vdata−Vth2, such that the amount of the current I flowing though the OLED 150 can be described as follows:

$$I=(½)\times\beta\times(Vsg2-Vth2)^2$$

$$I=(½)\times\beta\times(Vdd-Vdata+Vth2-Vth2)^2$$

$$I=(½)\times\beta\times(Vdd-Vdata)^2,$$

wherein β is the transconductance parameter of the driving TFT T2. By the above-mentioned formulas, it is seen that the amount of output current of the OLED 150 does not depend on the Vth2 (the threshold voltage of the driving TFT T2) and only depends on the amount of the data signal voltage (Vdata) to be written. Thus, the variance in the threshold voltage of the driving TFT T2 caused by the factor of the manufacturing process can be compensated.

Figure 4:
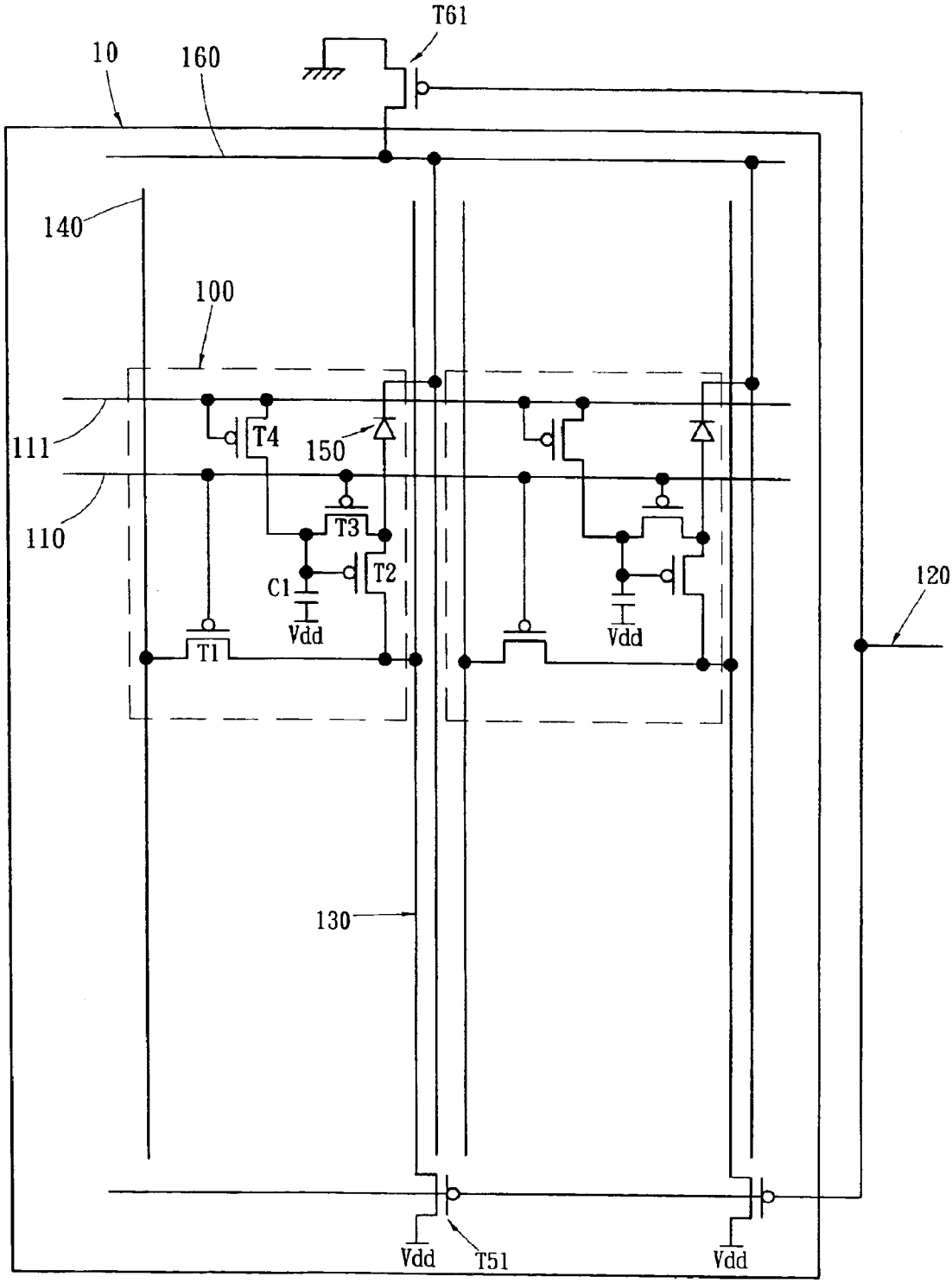
FIG. 4 is the schematic view of a pixel driving circuit according to the present invention.
Figure 5:
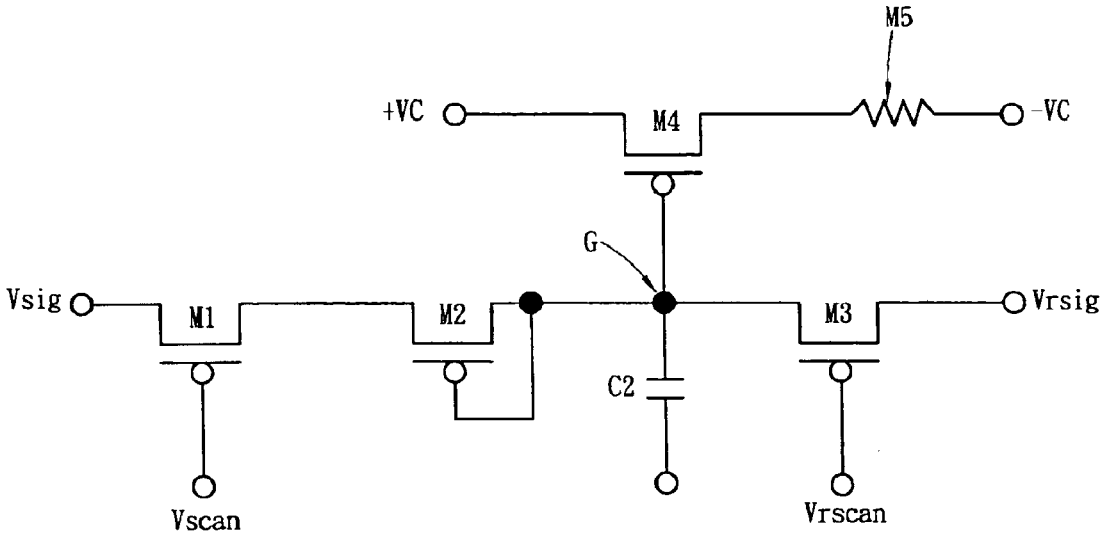
F I G. 5 PRIOR ART
FIG. 5 is the schematic view of a pixel driving circuit according to the U.S. Pat. No. 6,362,798.
Figure 6:
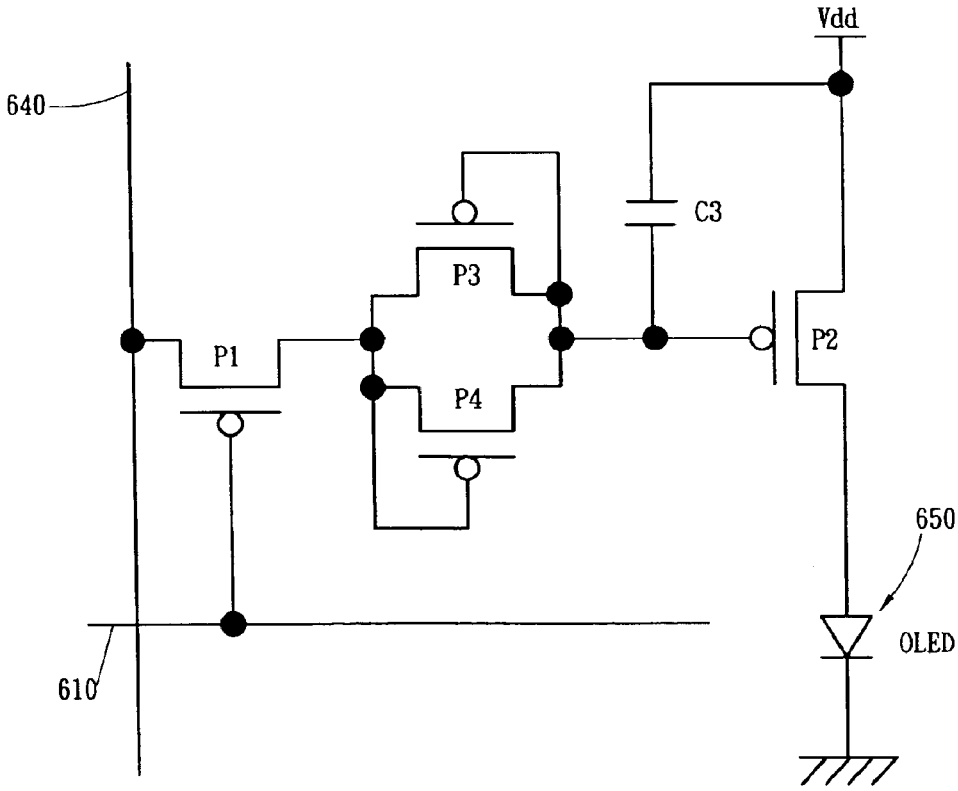
F I G. 6 PRIOR ART
FIG. 6 is the schematic view of a pixel driving circuit according to the thesis published by Seoul University (Korea).

The Third Embodiment:

Referring to FIG. 4, it is the schematic view of a further pixel driving circuit according to the present invention. Each scan line 110 and each data line 140, which are disposed on a display panel according to the present invention, crosswise constitute a pixel 100. The pixel driving circuit disposed on the pixel 100 includes:

a scan TFT T1, of which a gate (G) is connected to the scan line 110 and of which a source (S) is connected to the data line 140;

a driving TFT T2, of which a source (S) is connected to the drain (D) of the scan TFT T1 and is further connected to a power supply line 130;

a diode-connected TFT T3, of which a source (S) is connected to the drain (D) of the driving TFT T2 and of which a gate (G) is connected to the scan line 110, and used for making the driving TFT T2 formed a diode-connected type;

a storage capacitor C1, having one end is connected to the gate (G) of the driving TFT T2 and the drain (D) of the diode-connected TFT T3, and the other end is connected to the power supply (Vdd);

a reset TFT T4, of which a source (S) is connected to the drain (D) of the diode-connected TFT T3 and of which a gate (G) and a drain (D) are formed to a diode-connected type and connected to the junction connected to a previous scan line 111; and an OLED 150, of which one end is an anode and connected to the drain (D) of the driving TFT T2, and of which the other end is cathode and connected to a common cathode line 160;

wherein all the pixels 100 disposed on the data line 140 are common connected to the same power supply line 130 and a Vdd-connected TFT T51 is disposed between the power supply line 130 and the power supply (Vdd), i.e. the Vdd-connected TFT T5 disposed on each pixel 100 in the first embodiment is replaced with the common power supply line 130 disposed on each pixel 100 in the vertical direction. Simultaneously, the gate (G) of the Vdd-connected TFT T51 of each the power supply line 130 disposed on the display panel 10 is connected in common to a light-emitting line 120 disposed on the display panel 10.

An exterior switch TFT T61 is disposed between the common cathode line 160 connected to the OLED 150 of all the pixel 100 disposed in the display panel 10 and the ground, i.e. the original OLED-connected TFT T6 in the first embodiment is removed outside the display panel 10, such that all pixel 100 disposed on the display panel 10 are common connected to the same exterior switch TFT T61. The common cathode joint of the OLED 150 of all pixel 100 disposed on the display panel 10 are connected to the earth through the exterior switch TFT T61, and the gate (G) of the exterior switch TFT T61 is connected to the light-emitting line 120 disposed on the display panel 10.

Thus, the amount of the electric current flowing through the OLED 150 of the pixel 100 according to the present invention can depends on the voltage of the storage capacitor C1 connected to the gate (G) of the driving TFT T2.

The principle of the operation of the pixel driver circuit in the third embodiment is described as follows:

Step 1: When the scan action is carried out, at first, the light-emitting line 120 disposed on the display panel 10 turns off the Vdd-connected TFT T51 and the exterior switch TFT 61.

Step 2: When the scan action is carried out on the previous scan line 111 of the pixel 100, the electrical potential of the previous scan line 111 is equal to zero. Thus, the storage capacitor C1 can be charged by the reset TFT T4 and finally the terminal voltage of the gate (G) of the driving TFT T2 is equal to the Vth4 (the threshold voltage of the reset TFT T4).

Step 3: When the scan action is continuously carried out on the scan line 110 disposed on the pixel 100, the electrical potential of the scan line 110 is equal to zero and simultaneously the scan TFT T1 and the diode-connected TFT T3 can be turned on. The gate (G) and the drain (D) of the driving TFT T2 are connected to each other and the driving TFT T2 is formed to a diode-connected type, because the diode-connected TFT T3 is turned on. The data voltage of the data line 140 proceeds to discharge the storage capacitor Cl through the scan TFT T1 and the driving TFT T2 with the diode-connected type. If the data voltage of the data line 140 is equal to Vdata, the terminal voltage of gate (G) of the driving TFT T2 gradually changes from Vth4 to Vdata−Vth2, and the location of the source (S) of the driving TFT T2 is defined at lower side of the driving TFT T2 as shown in FIG. 2. Simultaneously, the electrical potential of the previous scan line 111 is equal to Vdd (the electrical potential of the power supply) and therefore the reset TFT T4 with the diode-connected type is turned off because of reverse bias.

Step 4: When the scan action is continuously carried out on next scan line disposed on the pixel 100, the electrical potential of the scan line 110 disposed on the pixel 100 is equal to Vdd again and simultaneously the scan TFT T1 and the diode-connected TFT T3 are turned off.

Step 5: When the scan action is completely carried out on all scan line, the light-emitting line 120 can turn on the Vdd-connected TFT T51 and the exterior switch TFT T61, and then there is an electric current flowing the OLED 150. Because the Vdd-connected TFT T51 is turned on, the terminal voltage of the source (S) of the driving TFT T2 is equal to Vdd, and then the terminal voltage of the gate (G) of the driving TFT T2 is equal to Vdata−Vth2, such that the amount of the current I flowing though the OLED 150 can be described as follows:

$$I=(1/2)\times\beta\times(Vsg2-Vth2)^2$$

$$I=(1/2)\times\beta\times(Vdd-Vdata+Vth2-Vth2)^2,$$

$$I=(1/2)\times\beta\times(Vdd-Vdata)^2$$

wherein β is the transconductance parameter of the driving TFT T2. By the above-mentioned formulas, it is seen that the amount of output current of the OLED 150 does not depend on the Vth2 (the threshold voltage of the driving TFT T2) and only depends on the amount of the data signal voltage (Vdata) to be written. Thus, the variance in the threshold voltage of the driving TFT T2 caused by the factor of the manufacturing process can be compensated.

As described above, the pixel circuit of the OLED display panel according to the present invention has the following advantages:

1. The present invention differs from the U.S. Pat. No. 6,362,798 and the thesis published by Seoul University (Korea) which mainly discloses that the Vth_comp should be equal to a Vth_driv during the manufacturing process and then the driving TFT M4 which of the variance in the threshold voltage caused by the factor of the manufacturing process can be compensated. Thus, according to the present invention, the requirement of the manufacturing process is not necessary, so as to be advantageous for the production yield of display panels.
2. The present invention is characterized in that the driving TFT formed to a diode-connected type and disposed between the terminal of the data signal voltage and the storage capacitor when the data signal voltage is stored to the storage capacitor, such that the driving TFT can compensate the variation of the threshold voltage itself thereof and precisely completely compensate the effect of the variation in the threshold voltage.
3. The present invention is characterized in that a data voltage written type can be realized by using a currently generally developed TFT-LCD Source IC (Voltage Mode) and is helpful to the development of active matrix type OLED display panels.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. A pixel driving circuit of an organic light emitting diode display panel display panel, each scan line and each data line, which are disposed on a display panel according to the present invention, crosswise constitute a pixel, said pixel driver circuit disposed on the pixel comprising:

a scan TFT having a gate (G) connected to the scan line and a source (S) connected to the data line;

a Vdd-connected TFT having a source (S) connected to the power supply (Vdd), a drain (D) connected to the drain (D) of the scan TFT, and a gate (G) connected to a light-emitting line;

a driving TFT having a drain (D) and a source (S) the source (S) being connected to the drain (D) of the Vdd-connected TFT;

a diode-connected TFT having a source (S) connected to the drain (D) of the driving TFT and a gate (G) connected to the scan line;

a storage capacitor having one end connected to the gate (G) of the driving TFT and the drain (D) of the diode-connected TFT, and the other end connected to the power supply (Vdd);

a reset TFT having a source (S) connected to the drain (D) of the diode-connected TFT, and a gate (G) and a drain (D) formed to a diode-connected type and connected to the junction connected to a previous scan line;

an OLED-connected TFT having a source (S) connected to the drain (D) of the driving TFT and a gate (G) connected to the light-emitting line; and an organic light emitting diode having one end being an anode and connected to the drain (D) of the OLED-connected TFT, and the other end being cathode and connected to the ground.

2. The pixel driving circuit of an organic light emitting diode display panel display panel according to claim 1, wherein the gate of the Vdd-connected TFT and the gate (G) of the OLED-connected TFT are controlled by the same light-emitting line 120.

3. The pixel driving circuit of an organic light emitting diode display panel display panel according to claim 1, wherein the driving TFT is formed a diode-connected type by the diode-connected TFT.

4. A pixel driving circuit of an organic light emitting diode display panel display panel, each scan line and each data line, which are disposed on a display panel according to the present invention, crosswise constitute a pixel, said pixel driver circuit disposed on the pixel comprising:

a scan TFT having a gate (G) connected to the scan line and a source (S) connected to the data line;

an OLED-connected TFT having a source (S) connected to the drain (D) of the scan TFT and a gate (G) connected to a light-emitting line;

an organic light emitting diode having one end being an anode and connected to the drain (D) of the OLED-connected TFT, and the other end being cathode and connected to the ground;

a driving TFT, having a drain (D) and a source (S), the source (S) of the driving TFT being connected to the source (S) of the OLED-connected TFT;

a diode-connected TFT having a source (S) connected to the drain (D) of the driving TFT and a gate (G) connected to the scan line;

a storage capacitor having one end connected to the gate (G) of the driving TFT and the drain (D) of the diode-connected TFT, and the other end connected to the power supply (Vdd);

a reset TFT having a source (S) connected to the drain (D) of the diode-connected TFT, and a gate (G) and a drain (D) formed to a diode-connected type and connected to the junction connected to a previous scan line; and a Vdd-connected TFT having a source (S) connected to the power supply (Vdd), a drain (D) connected to the drain (D) of the driving TFT, and a gate (G) connected to the light-emitting line.

5. The pixel driver circuit of an organic light emitting diode display panel display panel according to claim 4, wherein the gate of the Vdd-connected TFT and the gate (G) of the OLED-connected TFT are controlled by the same light-emitting line.

6. The pixel driver circuit of an organic light emitting diode display panel display panel according to claim 4, wherein the driving TFT is formed a diode-connected type by the diode-connected TFT.

7. A pixel driver circuit of an organic light emitting diode display panel display panel, each scan line and each data line, which are disposed on a display panel according to the present invention, crosswise constitute a pixel, said pixel driver circuit disposed on the pixel comprising:

a scan TFT having a gate (G) connected to the scan line and a source (S) connected to the data line;

a driving TFT having a source (S) connected to the drain (D) of the scan TFT and further connected to a power supply line;

a diode-connected TFT having a source (S) connected to the drain (D) of the driving TFT and a gate (G) connected to the scan line;

a storage capacitor having one end connected to the gate (G) of the driving TFT and the drain (D) of the diode-connected TFT, and the other end connected to a power supply (Vdd);

a reset TFT having a source (S) connected to the drain (D) of the diode-connected TFT and a gate (G) and a drain (D) formed to a diode-connected type and connected to the junction connected to a previous scan line; and an OLED having one end being an anode and connected to the drain (D) of the driving TFT, and the other end being cathode and connected to a common cathode line.

8. The pixel driver circuit of an organic light emitting diode display panel display panel according to claim 7, wherein all the pixels disposed on the data line are common connected to the same power supply line.

9. The pixel driver circuit of an organic light emitting diode display panel display panel according to claim 7, further comprising:

a Vdd-connected TFT disposed between the power supply line and the power supply (Vdd).

10. The pixel driver circuit of an organic light emitting diode display panel display panel according to claim 9, wherein the organic light emitting diode display panel display panel further including a light-emitting line; and the gate of the Vdd-connected TFT of each the power supply line disposed on the organic light emitting diode display panel are in common connected to the light-emitting line.

11. The pixel driver circuit of an organic light emitting diode display panel display panel according to claim 7, further comprising:

an exterior switch TFT disposed between the common cathode line connected to the OLED of all the pixel disposed in the organic light emitting diode display panel display panel and the ground.

12. The pixel driver circuit of an organic light emitting diode display panel display panel according to claim 11, wherein the gate of the exterior switch TFT is connected to the light-emitting line of the organic light emitting diode display panel display panel.

13. The pixel driver circuit of an organic light emitting diode display panel display panel according to claim 7, wherein the driving TFT is formed a diode-connected type by the diode-connected TFT.

* * * * *